US009712932B2

(12) United States Patent
Dundas

(10) Patent No.: US 9,712,932 B2
(45) Date of Patent: Jul. 18, 2017

(54) USER INTERFACE CONTROL OF MULTIPLE PARAMETERS FOR A HEARING ASSISTANCE DEVICE

(75) Inventor: John Andrew Dundas, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 649 days.

(21) Appl. No.: 13/561,819

(22) Filed: Jul. 30, 2012

(65) Prior Publication Data

US 2014/0029776 A1 Jan. 30, 2014

(51) Int. Cl.
*H04R 25/00* (2006.01)

(52) U.S. Cl.
CPC ..... *H04R 25/75* (2013.01); *H04R 25/552* (2013.01); *H04R 25/70* (2013.01); *H04R 2225/41* (2013.01); *H04R 2225/43* (2013.01); *H04R 2225/61* (2013.01)

(58) Field of Classification Search
CPC ..... H04R 25/48; H04R 25/70; H04R 25/75; H04R 2225/021; H04R 2225/023; H04R 2225/025; H04R 2225/39; H04R 2225/55; H04R 2225/61; A61B 5/121; A61B 5/128
USPC ... 381/58, 60, 312, 314, 315, 320, 321, 322, 381/328, 330, 104, 107, 323; 600/25, 600/559; 607/55, 56, 57; 73/585
See application file for complete search history.

(56) References Cited

U.S. PATENT DOCUMENTS 4,961,230 A * 10/1990 Rising ..... 381/323
5,167,236 A 12/1992 Junker
5,795,287 A 8/1998 Ball et al.
2008/0292126 A1 11/2008 Sacha et al.
2010/0158262 A1 6/2010 Schumaier et al.
2010/0260366 A1* 10/2010 Heerlein et al. ..... 381/323
2011/0054241 A1 3/2011 Jensen et al.
2011/0091059 A1 4/2011 Sacha
2012/0189130 A1* 7/2012 Lee ..... A61B 5/121 381/60
2013/0039517 A1* 2/2013 Nielsen et al. ..... 381/314

OTHER PUBLICATIONS

"European Application Serial No. 13178503.2, Examination Notification Art. 94(3) mailed Sep. 10, 2014", 4 pgs.
"European Application Serial No. 13178503.2, Office Action mailed Feb. 10, 2014", 2 pgs.

(Continued)

*Primary Examiner* — Huyen D Le
(74) *Attorney, Agent, or Firm* — Schwegman, Lundberg & Woessner, P.A.

(57) ABSTRACT

Disclosed herein, among other things, are methods and apparatus for a user interface control to allow control of multiple parameters from a single control for a hearing assistance device. One aspect of the present subject matter relates to hearing assistance device for a wearer, including a housing, hearing assistance electronics housed in the housing, and a tinnitus therapy generator housed in the housing. A user interface control is connected to the electronics and the generator, and the control is configured to sense input from the wearer and provide for selection and adjustment of operational parameters for the electronics and the generator based on the sensed input. Other aspects are provided without departing from the scope of the present subject matter.

20 Claims, 2 Drawing Sheets

(56) References Cited

OTHER PUBLICATIONS

"European Application Serial No. 13178503.2, Response filed Jul. 31, 2014", 21 pgs.
"European Application Serial No. 13178503.2, Extended European Search Report mailed Oct. 2, 2013", 7 pgs.
"European Application Serial No. 13178503.2, Response filed Feb. 2, 2016 to Summons to Attend Oral Proceedings mailed Apr. 9, 2015", 12 pgs.
"European Application Serial No. 13178503.2, Summons to Attend Oral Proceedings mailed Apr. 9, 2015", 7 pgs.

* cited by examiner

USER INTERFACE CONTROL OF MULTIPLE PARAMETERS FOR A HEARING ASSISTANCE DEVICE

FIELD OF THE INVENTION

The present subject matter relates generally to hearing assistance devices, and in particular to a user interface control to allow control of multiple parameters from a single control for a hearing assistance device.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use transducer and electro-mechanical components which are connected via wires to the hearing aid circuitry.

Tinnitus is a condition in which a patient perceives sound in their ear in the absence of corresponding external sound. While ringing of the ears is associated with tinnitus, other types of sounds can be perceived and can be sporadic, intermittent or continuous. Tinnitus can be caused by a number of conditions or injuries, but regardless of cause can be debilitating and decrease a patient's quality of life.

What is needed in the art is an improved system for controlling multiple parameters from a single control for a hearing assistance device.

SUMMARY

Disclosed herein, among other things, are methods and apparatus for a user interface control to allow control of multiple parameters from a single control for a hearing assistance device.

One aspect of the present subject matter relates to a hearing assistance device for a wearer, including a housing, hearing assistance electronics housed in the housing, and a tinnitus therapy generator housed in the housing. A user interface control is connected to the electronics and the generator, and the control is configured to sense input from the wearer and provide for selection and adjustment of operational parameters for the electronics and the generator based on the sensed input.

Another aspect of the present subject matter relates to a method of using a hearing assistance device including hearing assistance electronics and a tinnitus therapy generator. A user interface control is provided on or in the device, the user interface control connected to the electronics and the generator. The control is used to sense a first input from a wearer of the hearing assistance device to select the hearing assistance electronics or the tinnitus therapy generator. A second input from the wearer is sensed using the control and used to adjust one or more parameters of the selected electronics or generator. Other aspects are provided without departing from the scope of the present subject matter.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
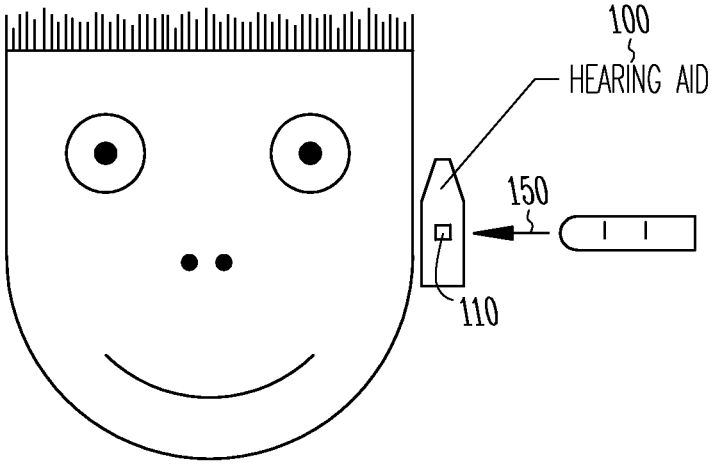
FIGS. 1A-1B illustrate a behind-the-ear hearing assistance device with an infrared sensor, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates generally to hearing assistance devices, and in particular to a user interface control to allow control of multiple parameters from a single control for a hearing assistance device. The hearing assistance devices referred to herein include, but are not limited to hearing aids. One aspect of the present subject matter relates to a hearing assistance device for a wearer, including a housing, hearing assistance electronics housed in the housing, and a tinnitus therapy generator housed in the housing. A user interface control is connected to the electronics and the generator, and the control is configured to sense input from the wearer and provide for selection and adjustment of operational parameters for the electronics and the generator based on the sensed input. The present subject matter thus provides discrete control of multiple features using a single control surface, and allows for greater user control over hearing aid features without increasing the physical size or complexity of the hearing device, and without requiring changes to the mechanical design of the device.

Tinnitus is a condition where an individual perceives a sound when no external sound is present. This condition affects more than 50 million Americans to varying degrees. At least a quarter of these individuals are bothered enough by their tinnitus to seek medical attention. Some people with tinnitus also experience a condition called hyperacusis, which is a reduction in tolerance for loud sounds. It is common for individuals with tinnitus and/or hyperacusis to experience feelings of anxiety or hopelessness related to their symptoms, while simultaneously experiencing difficulty with concentration. Common accompanying complaints include fears of the presence of a life threatening condition and questions of whether the perceived sound is real or a figment of the imagination. Tinnitus often accompanies hearing loss. Current neurophysiologic models of tinnitus suggest that a reduction in input to the central auditory system due to hearing loss creates an over-sensitization of the auditory system, where random firings of the auditory system are perceived as persistent sounds.

Patients with tinnitus often experience hearing loss at the same time. As a result, it is efficacious to use combination devices that incorporate amplification of environmental sounds and generation of tinnitus sound therapy stimuli. When using a combination device, it is desirable to control the intensity of sound therapy stimuli independently of the gain of the hearing assistance device. For example, in some circumstances the amplification of environmental sound is less desirable but the attendant quiet environment makes tinnitus more audible.

Hearing aids, personal sound generators and devices which combine the two ("combination devices") are devices worn at the ear level that are used in tinnitus and hyperacusis treatment programs that incorporate sound therapy. The goal of the treatment is to reduce the apparent loudness of the tinnitus, and to desensitize the individual to the presence of sound in the environment. This is accomplished in one or both of two ways. First, application of amplification provides stimulation to the central auditory system in areas of hearing loss, decreasing the sensitivity of the system, and decreasing the likelihood of experiencing 'phantom sounds' of tinnitus. Second, producing a competing noise in the ear similar to white noise or gentle rain reduces the apparent intensity of the tinnitus. This reduction in perceived loudness commonly leads to an attendant reduction in the importance of the tinnitus, and reduction in the accompanying feelings of anxiety.

Because exposure to loud sounds can aggravate tinnitus, and the apparent intensity and annoyance of the tinnitus varies throughout the day, individual control of hearing aid gain and masking noise level are common adjustments requested by tinnitus sufferers. Providing individual gain controls for the two parameters is difficult when utilizing a compact hearing aid/combination device due to physical space limitations. Provision of two miniaturized volume control wheels is possible; however physical manipulation of the individual controls is difficult due to the small size. Combining adjustments for both amplification and masking noise into a single control would allow the aforementioned functionality without compromising the physical size of the combination device.

The present subject matter relates to a method of allowing a user to select and control discrete features of the response of a combination programmable hearing aid and noise generator device used, for example, in the treatment of tinnitus and hearing loss. Hearing aids have been developed that provide amplification for ambient noise and speech signals, while simultaneously generating a broadband, random or controlled noise for the purpose of masking tinnitus, i.e., "ringing or other sounds in the ear". This masking noise is used in various tinnitus therapies including tinnitus retraining therapy (TRT) to help reduce the apparent intensity and annoyance factor of the unwelcome sounds. The devices have been limited in the ease with which the user can adjust the relative loudness of the amplification and noise generation circuits. In various embodiments, a capacitive switch control surface allows independent user control of both the amplification and masker circuits. Different gestures, e.g., tap and release, vs. press and hold then release can be implemented as software inputs that would indicate the user's selection of the feature to adjust. By tapping and releasing, then, then sweeping the finger upwards across the control surface, the user could increase the volume of the hearing aid circuit. Conversely, sweeping the finger downwards across the control surface would decrease the volume of the hearing aid. A press, hold, then release, or a double tap of the control surface would indicate the selection of the masker circuit. Similar to the procedure described above, a sweep of the finger across the control surface would then control the loudness of the masking noise independently of the gain of the hearing aid.

Figure 1B:
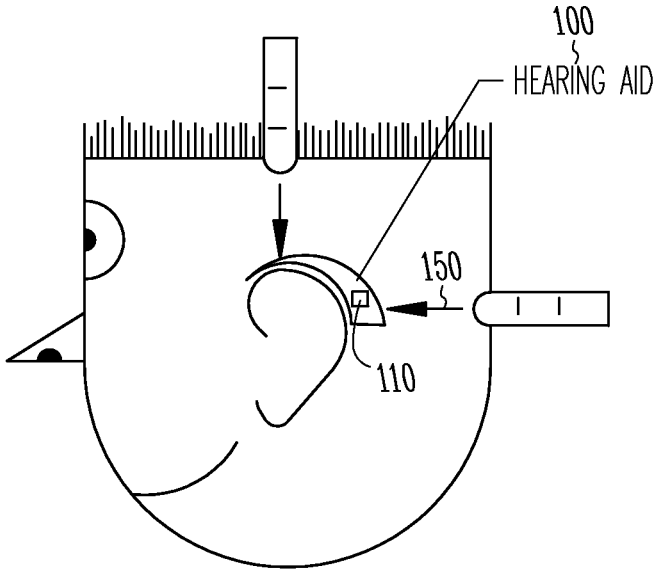
Figure 2:
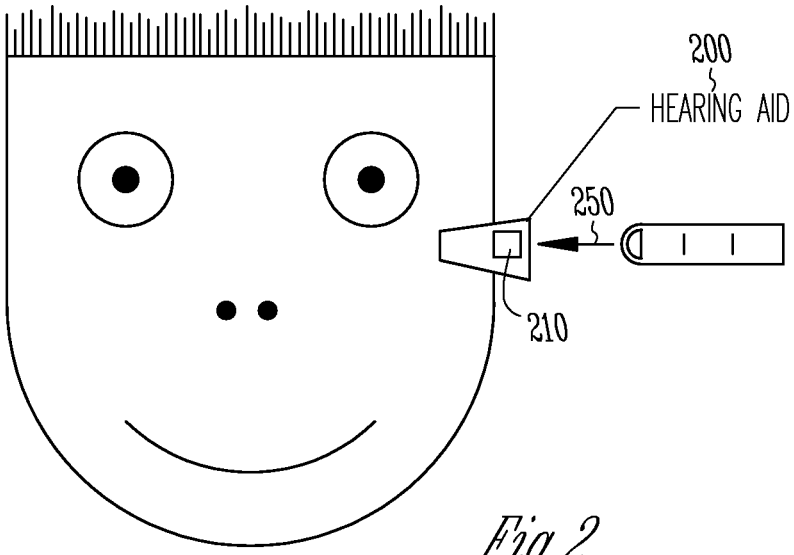
FIG. 2 illustrates an in-the-ear hearing assistance device with an infrared sensor, according to various embodiments of the present subject matter.

FIGS. 1A-1B illustrate a behind-the-ear hearing assistance device 100 with a user interface control 110, according to various embodiments of the present subject matter. By "tapping" or "swiping" at appropriate locations on or near the device using a wearer's finger 150, selection of hearing assistance control or tinnitus therapy generator control and parameter changes for the selected control can be performed, for example. Other functions and parameter changes can be performed without departing from the scope of this disclosure. The user interface control can also be used with in-the-ear (ITE) devices. As shown in FIG. 2, a tapping or swiping action with a finger 250 on or near the surface of the ITE hearing device 200 can be detected by a user interface control 210 and processed.

Figure 3:
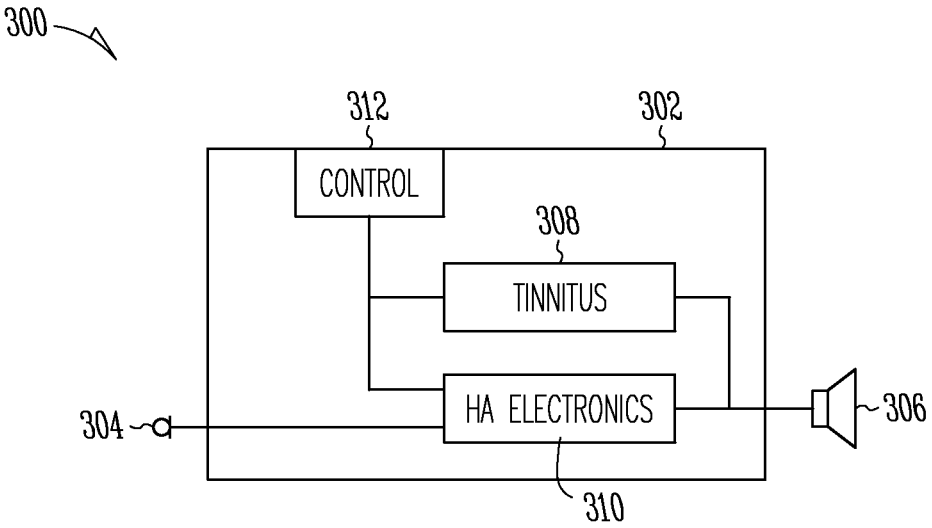
FIG. 3 illustrates a block diagram showing a signal path in a hearing assistance device used to provide both hearing assistance and therapy for tinnitus to a patient, according to one embodiment of the present subject matter.

FIG. 3 illustrates a block diagram of showing a signal path in a hearing assistance device used to provide both hearing assistance and therapy for tinnitus to a patient, according to one embodiment of the present subject matter. The hearing assistance device 300 includes an input 304, such as a microphone, connected to hearing aid electronics 310. The hearing assistance device 300 for a wearer includes a housing 302, hearing assistance electronics 310 housed in the housing, and a tinnitus therapy generator 308 housed in the housing. A user interface control 312 is connected to the electronics 310 and the generator 308, and the control 312 is configured to sense input from the wearer and provide for selection and adjustment of operational parameters for the electronics and the generator based on the sensed input.

In tinnitus therapy mode, a tinnitus therapy generator (or tinnitus sound generator) 308 generates a signal to be used for tinnitus therapy. The signal is presented to the user using the hearing assistance device receiver 306, or speaker. Tinnitus patients wear the device and alleviate the symptom by listening to the therapy, in various embodiments.

According to various embodiments, the user interface control includes a capacitive switch. The user interface control is within the housing, in an embodiment. In another embodiment, the user interface control is on the housing. The operational parameters include discrete features of a response of the hearing assistance device, for example. In an embodiment, the operational parameters include relative loudness of amplification of the hearing assistance electronics and noise generation of the tinnitus therapy generator. In various embodiments, the input from the wearer includes a tap and release to select the hearing assistance electronics and a press, hold and release to select the tinnitus therapy generator. Where the hearing assistance electronics are selected, a subsequent input from the wearer includes a sweep up to increase gain of the selected hearing assistance electronics, for example. Where the tinnitus therapy generator is selected, a subsequent input from the wearer includes a sweep up to increase loudness of the selected tinnitus therapy generator, for example.

Another aspect of the present subject matter relates to a method of using a hearing assistance device including hearing assistance electronics and a tinnitus therapy generator. A user interface control is provided on or in the device, the user interface control connected to the electronics and the generator. The control is used to sense a first input from a wearer of the hearing assistance device to select the hearing assistance electronics or the tinnitus therapy generator. A second input from the wearer is sensed using the control and used to adjust one or more parameters of the selected electronics or generator.

The user interface control is provided on a faceplate of the hearing assistance device, in an embodiment. In another embodiment, the user interface control is provided on a behind-the-ear hearing assistance device housing. The user interface control includes a capacitive switch control on a surface of the device, in an embodiment. Other types of switches or sensors can be used without departing from the scope of the present subject matter. For example, a digital rocker switch could be used to control similar functions, by requiring a brief up-down toggle to control one feature, and a different sequence of toggles (e.g., up-up, or down-down) to select alternate feature control. In various embodiments, non-ear level controls can be used to select or control hearing assistance electronics and the tinnitus therapy generator.

In one embodiment, the control is used to sense a tap and release by the wearer to select the hearing assistance electronics. The control is used to sense a press, hold and release by the wearer to select the tinnitus therapy generator, for example. In another embodiment, the control is used to sense a double tap by the wearer to select the tinnitus therapy generator. The control is used to sense the first input from the wearer of the hearing assistance device to select both the hearing assistance electronics and the tinnitus therapy generator, in an embodiment. In various embodiments, the control is adapted to sense a sweep up by a wearer to increase gain of the selected hearing assistance electronics. The control is configured to sense a sweep up to increase loudness of the selected tinnitus therapy generator, in an embodiment.

Other settings of the tinnitus generator and the hearing assistance electronics can be adjusted by the wearer without departing from the scope of the present subject matter. For example, the present subject matter for the tinnitus therapy stimulus allows the wearer to manually adjust the level and frequency response of the tinnitus sound generator. The control surface of the present subject matter can be used to tune or adjust the frequency shaping of the tinnitus therapy stimulus, in various embodiments. In one embodiment, the wearer taps three times and then can shift the spectral centroid (equivalent to the perception of pitch) of the tinnitus therapy stimulus up or down with a swipe on the control surface. In various embodiments, the tinnitus therapy stimulus is randomly generated, and the pitch of the randomly generated stimulus is adjusted using the control of the present subject matter.

It is understood that variations in communications standards, protocols, and combinations of components may be employed without departing from the scope of the present subject matter. Hearing assistance devices typically include an enclosure or housing, a microphone, hearing assistance device electronics including processing electronics, and a speaker or receiver. Processing electronics include a controller or processor, such as a digital signal processor (DSP), in various embodiments. Other types of processors may be used without departing from the scope of this disclosure. It is understood that in various embodiments the microphone is optional. It is understood that in various embodiments the receiver is optional. Thus, the examples set forth herein are intended to be demonstrative and not a limiting or exhaustive depiction of variations.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device for a wearer, the device comprising:

a housing;

hearing assistance electronics housed in the housing;

a tinnitus therapy generator housed in the housing;

a user interface control on a surface of the housing connected to the electronics and the generator, the control configured to sense input from the wearer and provide for selection of hearing assistance control or tinnitus therapy control, and the control further configured to provide adjustment of a plurality of operational parameters for the electronics if hearing assistance control is selected and adjustment of a plurality of operational parameters configured to control frequency shaping, pitch and amplification for the generator if tinnitus therapy control is selected.

2. The device of claim 1, wherein the user interface control includes a capacitive switch.

3. The device of claim 1, wherein the user interface control is within the housing.

4. The device of claim 1, wherein the user interface control is on the housing.

5. The device of claim 1, wherein the operational parameters for the tinnitus therapy generator include frequency shaping of tinnitus therapy stimulus.

6. The device of claim 1, wherein the operational parameters include relative loudness of amplification of the hearing assistance electronics and noise generation of the tinnitus therapy generator.

7. The device of claim 1, input from the wearer includes a tap and release to select the hearing assistance electronics.

8. The device of claim 7, wherein a subsequent input from the wearer includes a sweep up to increase gain of the selected hearing assistance electronics.

9. The device of claim 1, wherein the input from the wearer includes a press, hold and release to select the tinnitus therapy generator.

10. The device of claim 9, wherein a subsequent input from the wearer includes a sweep up to increase loudness of the selected tinnitus therapy generator.

11. A method of using a hearing assistance device including hearing assistance electronics and a tinnitus therapy generator, the method comprising:

providing a user interface control on a surface of a housing of the hearing assistance device, the user interface control connected to the electronics and the generator;

using the control to sense a first input from a wearer of the hearing assistance device to select the hearing assistance electronics or the tinnitus therapy generator; and using the control to sense a second input from the wearer to adjust a plurality of parameters of the electronics or a plurality of parameters of the generator configured to control frequency shaping, pitch and amplification, based on the selection of the hearing assistance electronics or the tinnitus therapy generator.

12. The method of claim 11, wherein providing a user interface control includes providing the user interface control on a faceplate of the hearing assistance device.

13. The method of claim 11, wherein providing a user interface control includes providing the user interface control on a behind-the-ear hearing assistance device housing.

14. The method of claim 11, wherein providing a user interface control includes providing a capacitive switch control on a surface of the device.

15. The method of claim 11, wherein using the control to sense a first input includes using the control to sense a tap and release by the wearer to select the hearing assistance electronics.

16. The method of claim 15, wherein using the control to sense a second input includes using the control to sense a sweep up by a wearer to increase gain of the selected hearing assistance electronics.

17. The method of claim 11, wherein using the control to sense a first input includes using the control to sense a press, hold and release by the wearer to select the tinnitus therapy generator.

18. The method of claim 17, wherein using the control to sense a second input includes using the control to sense a sweep up to increase loudness of the selected tinnitus therapy generator.

19. The method of claim 11, wherein using the control to sense a first input includes using the control to sense a double tap by the wearer to select the tinnitus therapy generator.

20. The method of claim 11, wherein using the control to sense a first input includes using the control to sense the first input from the wearer of the hearing assistance device to select the hearing assistance electronics and the tinnitus therapy generator.

* * * * *